US005823530A

United States Patent [19]

Yang

[11] Patent Number: 5,823,530

[45] Date of Patent: Oct. 20, 1998

[54] SPATIAL PUZZLE CUBE

[76] Inventor: Ju-Shun Yang, 58, Ma Yuan West St., Taichung, Taiwan

[21] Appl. No.: 501,422

[22] Filed: Jul. 3, 1995

[51] Int. Cl.[6] ..... A63F 9/08

[52] U.S. Cl. ..... 273/153 S; 273/155

[58] Field of Search ..... 273/153 R, 153 S, 273/155

[56] References Cited

U.S. PATENT DOCUMENTS

| | | | |
|---|---|---|---|
| 4,416,453 | 11/1983 | Sasso | 273/153 S |
| 4,836,549 | 6/1989 | Flake | 273/153 S |
| 5,215,305 | 6/1993 | Hsun | 273/153 S |

FOREIGN PATENT DOCUMENTS

| | | | |
|---|---|---|---|
| 512928 | 11/1992 | European Pat. Off. | 273/153 S |

*Primary Examiner*—William M. Pierce

[57] ABSTRACT

A spatial puzzle cube comprises a main body with six surfaces and eight corners. Each surface has a circular depression. Each corner has a triangular depression. A fixed disc with eight slide grooves is disposed in each circular depression. A rotated disc with eight recesses is disposed on each corresponding fixed disc. A fixed pyramid with three slide slots is disposed in each triangular depression. A rotated trilateral pyramid with three slots is disposed on each corresponding fixed pyramid.

1 Claim, 6 Drawing Sheets

SPATIAL PUZZLE CUBE

BACKGROUND OF THE INVENTION

The invention relates to a puzzle cube. More particularly, the invention relates to a spatial puzzle cube which has a cubic outer appearance with six rotated discs and eight rotated trilateral pyramids.

Referring to FIG. 1, a conventional puzzle cube 100 has six surfaces and each surface has nine sub-pieces.

Referring to FIG. 2, a game apparatus which comprises a body 10, a plurality of shells 12 and a plurality of caps 32 has a spherical outer appearance. U.S. Pat. No. 5,215,305 describes the game apparatus of FIG. 2 in detail. The cited patent belongs to the same inventor. However, the game apparatus only has six rotatable portions so that the structure of the game apparatus is more simple than that of the present invention.

SUMMARY OF THE INVENTION

An object of the invention is to provide a spatial puzzle cube which has rotated discs and rotated trilateral pyramids to be rotated.

Accordingly, a spatial puzzle cube is in a cubic shape. A main body has six surfaces and eight corners. A circular depression formed on each of the surface. A trianglular depression formed on each of the corner. A fixed disc with a plurality of slide grooves is disposed in each of the circular depression. A rotated disc with a plurality of recesses is disposed on the corresponding fixed disc. A fixed pyramid with three slide slots is disposed on each of the triangular depression. A rotated trilateral pyramid with three slots is disposed on the corresponding fixed pyramid.

DETAILED DESCRIPTION OF THE INVENTION

Figure 1:
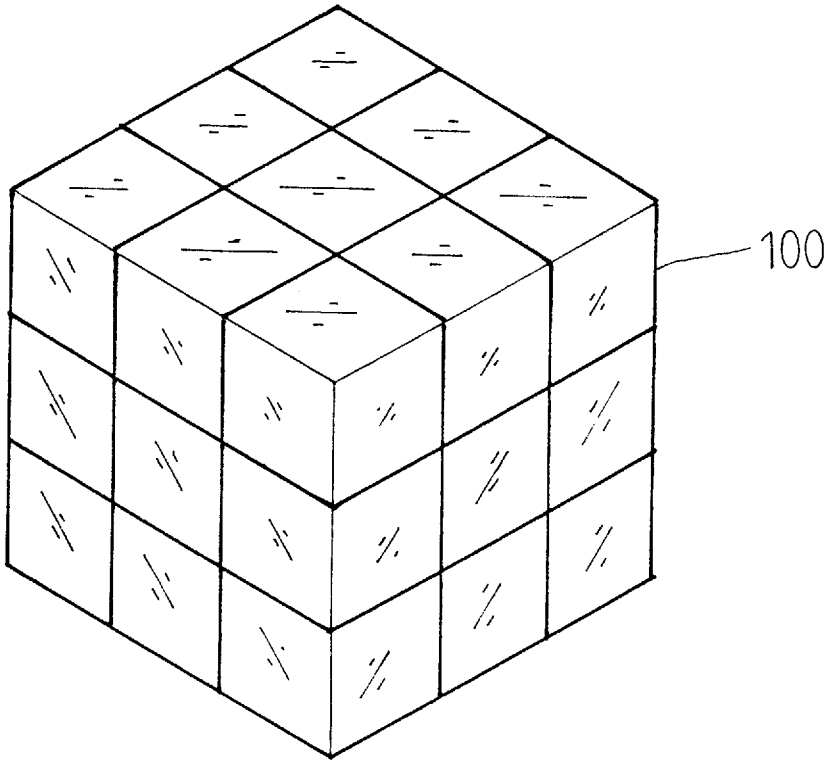
FIG. 1 PRIOR ART
FIG. 1 is a perspective assembly view of a conventional puzzle cube of the prior art.
Figure 2:
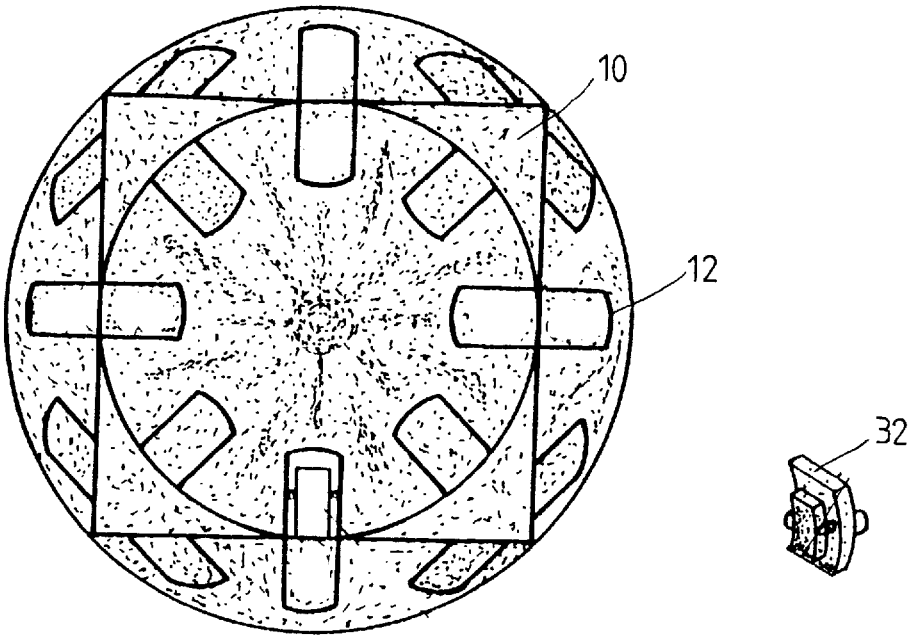
F I G. 2 PRIOR ART
FIG. 2 is a plan view of a game apparatus of the prior art.
Figure 3:
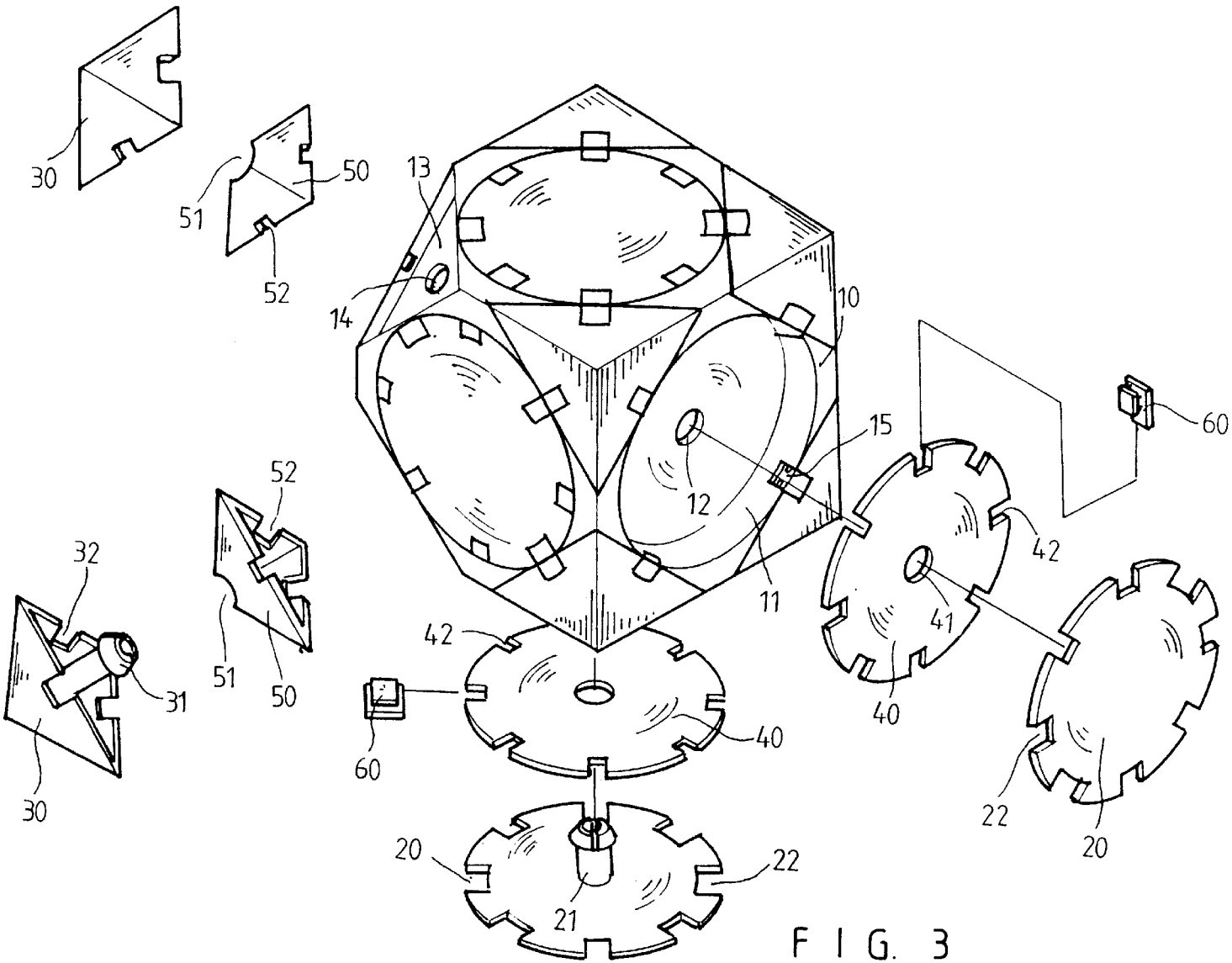
FIG. 3 is a partly exploded, perspective view of a spatial puzzle cube of a preferred embodiment in accordance with the invention.
Figure 4:
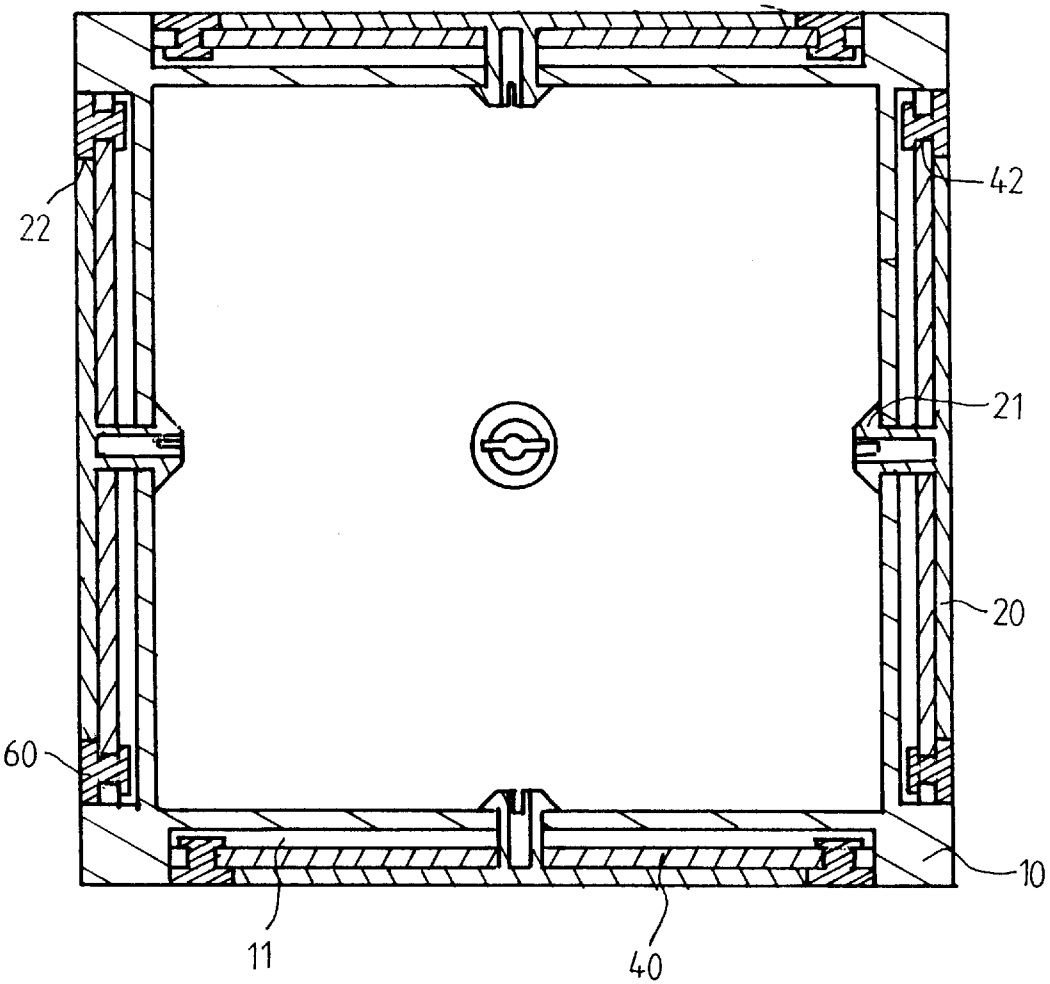
FIG. 4 is a cross-sectional, assembly view of FIG. 3.
Figure 5:
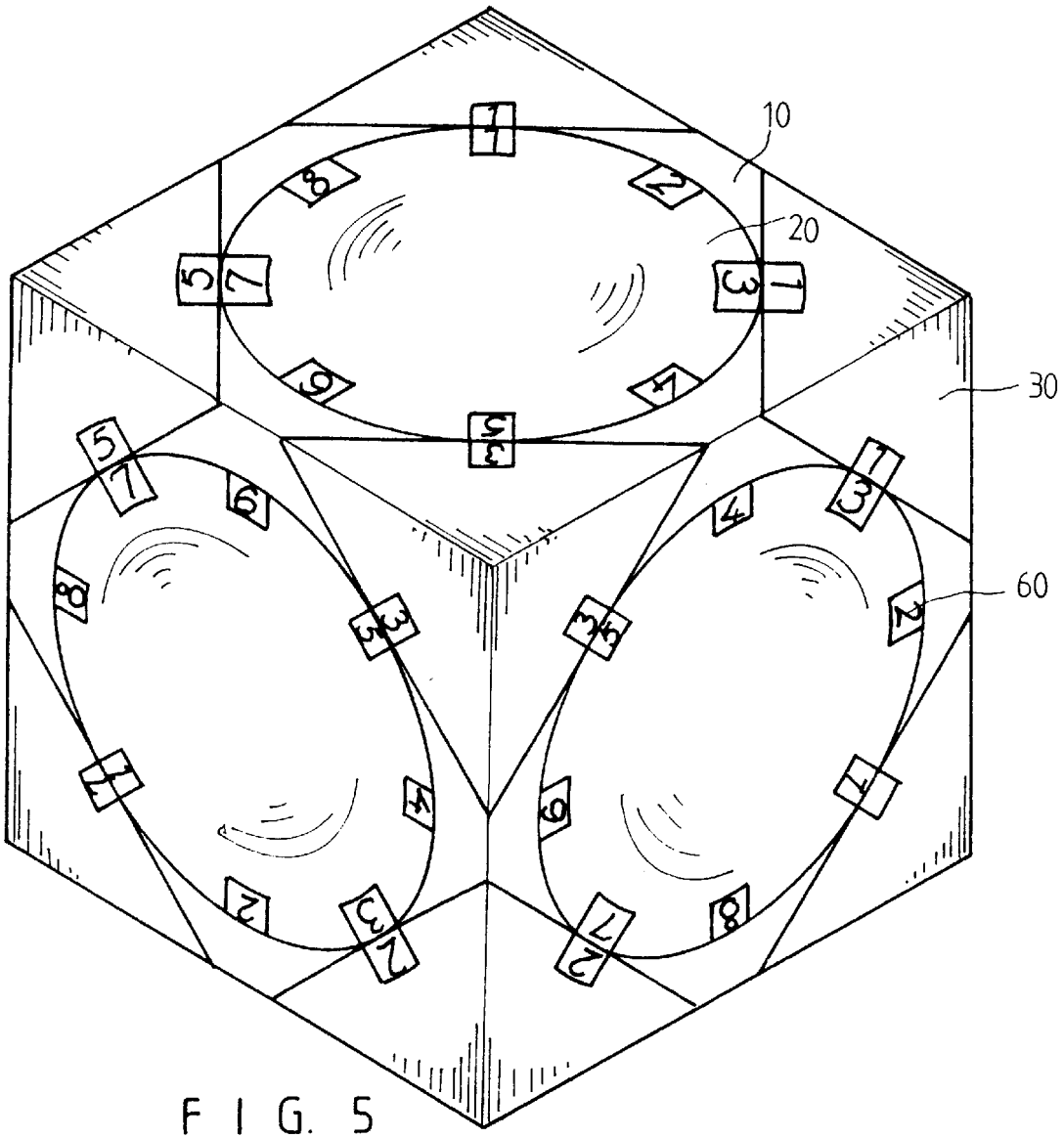
FIG. 5 is a perspective assembly view of FIG. 3.

Referring to FIGS. 3 to 6, a spatial puzzle cube contains a main body 10, a plurality of rotated discs 20, a plurality of rotated trilateral pyramids 30, a plurality of fixed discs 40 and a plurality of fixed pyramids 50. The main body 10 which is a cubic solid with a hollow interior has six circular depressions 11 on six surfaces of the main body 10, respectively. Each circular depression 11 has a central hole 12 therein. A triangular depression 13 is disposed on each corner of the main body 10. A retaining hole 14 is formed on the center of the triangular depression 13. The contact area between the circular depression 11 and the triangular depression 13 has a notch 15 to facilitate the motion of a movable slide 60. The rotated disc 20 has eight recesses 22 at periphery to receive the slides 60 and a central post 21 to restrict the position of the fixed disc 40. Each fixed disc 40 has a central hole 41 and eight slide grooves 42 to receive the slides 60. The trilateral pyramid 30 has a central rod 31 and three slots 32 to receive the slides 60. The shape of the fixed pyramid 50 is similar to that of the trilateral pyramid 30. A through hole 51 is formed on the center of the fixed pyramid 50, and three slide slots 52 are formed at the periphery of the fixed pyramid 50 to receive slides 60. The slide 60 is inserted and restricted in the slide groove 42 or the slide slot 52.

The central post 21 passes through the hole 41 and the central hole 12. The central rod 31 passes through the through hole 51 and the retaining hole 14. The rotated disc 20 and the corresponding fixed disc 40 are disposed in the circular depression 11. The trilateral pyramid 30 and the fixed pyramid 50 are disposed in the triangular depression 13. The spatial puzzle cube has six rotated discs 20 and eight rotated trilateral pyramids 30. Seventy two slides 60 are disposed on the surfaces of the spatial puzzle cube.

Figure 6:
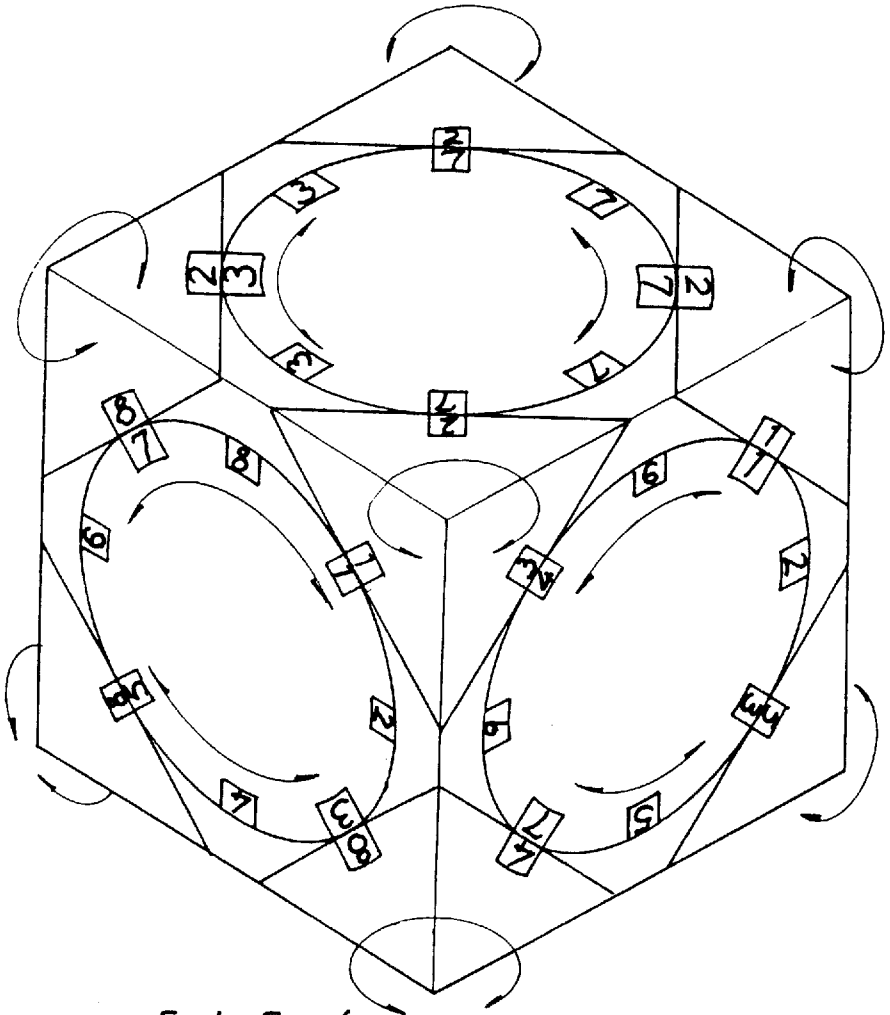
FIG. 6 is a schematic view showing the rotation of rotated discs and rotated trilateral pyramids in FIG. 3.

Referring to FIG. 6, each rotated disc 20 can be rotated clockwisely or anticlockwisely within one surface of the spatial puzzle cube. The rotated trilateral pyramid 30 can be rotated clockwisely or anticlockwisely among three adjacent surfaces of the spatial puzzle cube. Thus the slide 60 can be transferred from one surface to another surface via the rotation of the rotated discs 20 and the rotated trilateral pyramides 30.

The invention is not limited to the above embodiment but various modification thereof may be made. It will be understood by those skilled in the art that various changes in form and detail may be made without departing from the spirit and scope of the invention.

What is claimed is:

1. A spatial puzzle cube comprising:

a main body having six surfaces and eight corners;

a circular depression formed on each of said surface;

a triangular depression formed on each of said corner;

a fixed disc with a plurality of slide grooves being disposed in each of said circular depression;

a rotated disc with a plurality of recesses being disposed on said corresponding fixed disc;

a fixed pyramid with three slide slots being disposed on each of said triangular depression;

a rotated trilateral pyramid with three slots being disposed on said corresponding fixed pyramid;

a plurality of slides disposed in said corresponding slide grooves;

a plurality of slides disposed in said corresponding slide slots;

means for securing the fixed disc and the rotated disc so that they can be rotated within the circular depression;

means for securing the fixed pyramid and the rotated trilateral pyramid so that they can be rotated within the triangular depression; and a means for securing the slides in the slide grooves and the slide slots.

* * * * *